US007629575B2

(12) United States Patent
Wells

(10) Patent No.: US 7,629,575 B2
(45) Date of Patent: Dec. 8, 2009

(54) CHARGE CONTROL FOR IONIC CHARGE ACCUMULATION DEVICES

(75) Inventor: Gregory J. Wells, Fairfield, CA (US)

(73) Assignee: Varian, Inc., Palo Alto, CA (US)

( * ) Notice: Subject to any disclaimer, the term of this patent is extended or adjusted under 35 U.S.C. 154(b) by 211 days.

(21) Appl. No.: 12/004,136

(22) Filed: Dec. 19, 2007

(65) Prior Publication Data

US 2009/0159791 A1 Jun. 25, 2009

(51) Int. Cl.
*H01J 49/42* (2006.01)

(52) U.S. Cl. ..... 250/281; 250/282

(58) Field of Classification Search ..... 250/281, 250/282

See application file for complete search history.

(56) References Cited

U.S. PATENT DOCUMENTS 6,987,261 B2 1/2006 Horning et al.
7,238,936 B2 * 7/2007 Okamura et al. ..... 250/284
7,405,401 B2 * 7/2008 Hoyes ..... 250/292

* cited by examiner

*Primary Examiner*—Kiet T Nguyen
(74) *Attorney, Agent, or Firm*—Bella Fishman

(57) ABSTRACT

A method for controlling charge flux into a charge accumulation device includes determining a charge accumulation time during which charges are to be accumulated in the charge accumulation device, measuring a charge flux of a first ion beam produced from an ion source, determining a target number of charges to be accumulated in the charge accumulation device during the charge accumulation time based on the measured charge flux and, based on the determined target number of charges, modulating a second ion beam produced from the ion source to cause the target number of charges from the second ion beam to be accumulated in the charge accumulation device during the charge accumulation time. An ion processing device is configured for controlling the charge flux. An ion beam modulator modulates the ion beam.

20 Claims, 14 Drawing Sheets

CHARGE CONTROL FOR IONIC CHARGE ACCUMULATION DEVICES

FIELD OF THE INVENTION

The present invention relates generally to the processing of ions such as may be implemented in fields of analytical chemistry such as, for example, mass spectrometry. More particularly, the invention relates to controlling the amount of ionic charge accumulated in an ion accumulation device.

BACKGROUND OF THE INVENTION

Ion (or charge) accumulation devices are well known in the art and can take many forms such as, for example, three-dimensional ion traps and two-dimensional (or "linear") ion traps. FIG. 1 illustrates an example of a three-dimensional ion trap 100. This type of ion trap may be constructed from electrodes formed by hyperboloids of revolution forming a top hyperbolic shape 102 and a bottom hyperbolic shape 104 (also termed end caps), and a center or ring electrode 106 that is also a hyperboloid of revolution. An alternating voltage may be applied to the center electrode 106 to form a three-dimensional quadrupolar restoring force directed towards the center of the electrode assembly. Ions are confined within an electrodynamic quadrupole field when their trajectories are bounded in the (r) and (z) directions. One or both end caps 102 and 104 may have one or more apertures 108 and 110. One of these apertures 108 or 110 is typically utilized to introduce externally produced ions into the ion trap 100, or alternatively to introduce an electron or photonic beam in the case of in-trap ionization. One or both of the apertures 108 and 110 may also be utilized to eject ions from the ion trap 100 in the (z) directions during the course of known ion processing techniques, for example analytical scans in the case of mass spectrometry. An ion detector (not shown) may be positioned to receive ions ejected from at least one of the apertures 108 or 110 to measure ion flux, count the number of ions received, etc.

FIG. 2 illustrates an example of a linear ion trap 200. This type of ion trap may be formed from four electrodes 202, 204, 206 and 208 of hyperbolic cross-section arranged about a central longitudinal axis, designated in FIG. 2 as the z-axis. These electrodes 202, 204, 206 and 208 may be provided in the form of cylindrical rods to approximate the hyperbolic shapes, as in the example illustrated in FIG. 2. Typically, one opposing pair of electrodes 202 and 204 are electrically interconnected, as are another opposing pair of electrodes 206 and 208. An alternating voltage is applied between the rod pairs 202/204 and 206/208. The alternating electric field thus generated creates a two-dimensional restoring force on an ion, which is directed towards the center axis of the rod structure. The quadrupolar restoring field is equivalent to a trapping field that traps the ions in the direction transverse to the central axis. If plates 212 and 214 are located at the ends of the rod structures and have a DC voltage applied to them, a force will be applied to an ion that is directed along the axis of the rods 202, 204, 206 and 208. Thus, ions will be confined along the x-axis and y-axis directions due to the alternating voltage gradient, and along the z-axis by means of the DC potential applied to the end plates 212 and 214. Typically, ions are introduced axially into this type of ion trap 200 through an aperture of a plate 212 or 214. Ions may be ejected axially or, alternatively, radially between adjacent rods 202, 204, 206 and 208 or through apertures or elongated slots formed in one or more of the rods 202, 204, 206 and 208. Other types of linear ion traps can be formed from utilizing more than four electrodes 202, 204, 206 and 208, such as six or eight, which will form higher order multipole fields besides quadrupole such as hexapole or octopole as is well known in the art. Additionally, multipole electrode sets may be operated as mass filters, collision cells, or simply ion guiding or focusing devices, as is also well-known.

It is known in the art to selectively eliminate ions of a specified mass-to-charge ratio from ion accumulation devices. In an ion trap, for example, selected ions may be eliminated (ejected) by applying a supplemental alternating voltage to the pair of end caps in the case of a three-dimensional ion trap or a pair of opposing rods in the case of a linear ion trap. Ions with a mass-to-charge ratio having a natural (or secular) frequency of oscillation matching the frequency of the supplemental voltage will be ejected from the trap in the direction of the applied supplemental field. Waveforms comprising multiple frequencies may be used to eject ions with multiple mass-to-charge ratios. If these multiple frequencies are applied during the time that ions are entering the ion accumulation device, unwanted ions can be continuously removed as they enter. The development of space charge in an ion accumulation device is undesirable for a number of reasons. For example, large amounts of space charge can result in a shift in the ion frequencies such that they are no longer in optimal resonance with the supplemental frequencies. In a similar manner, ions that are close in frequency to a supplemental frequency can be shifted into resonance with that frequency and thereby be ejected. Therefore, a well recognized need exists for addressing space charge in the design and operation of ion accumulation devices.

In methods such as disclosed in U.S. Pat. No. 6,987,261, the number of charges in an ion accumulation device or ion trap mass spectrometer is based on allowing the charge flux to change and to control the time period during which charges are accumulated. This type of technique may be explained by referring to FIGS. 3A and 3B of the present disclosure. As the charge flux increases because the sample amount increases (FIG. 3A), the ion accumulation time is reduced so as to accumulate a constant number of charges (FIG. 3B). Therefore, at a low sample amount the ion accumulation time is large ($\Delta t_{a1}$). As the sample amount increases, the ion accumulation time becomes smaller ($\Delta t_{a2}$). The charges are introduced into the ion accumulation device in a single packet of variable length due to the variable accumulation time. As the period decreases the length of the ion packet decreases, but the charge density actually increases. Therefore, increasing the sample amount will cause an undesirable increase in the ion space charge density, which results in the undesired shift of the ion frequency.

Accordingly, a need continues to exist for more effective apparatus and methods for reducing the undesired affects of space charge in an ion trap or other device employed for charge accumulation. In accordance with certain implementations taught in the present disclosure, such a need may be met by controlling the ionic charge flux entering the accumulation device in a fixed accumulation time period, $T_{ac}$, rather than varying the accumulation time period, and thereby maintaining the space charge density. An additional benefit provided by certain implementations taught in the present disclosure is to maintain a constant scan-to-scan time because the ion accumulation time $T_{ac}$ is kept constant, while the charge flux is modulated. This is in contrast to the prior art in which the accumulation time is varied as the charge flux from the ion source changes.

SUMMARY OF THE INVENTION

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one implementation, a method is provided for controlling charge flux into a charge accumulation device. The method includes determining a charge accumulation time during which charges are to be accumulated in the charge accumulation device, measuring a charge flux of a first ion beam produced from an ion source, determining a target number of charges to be accumulated in the charge accumulation device during the charge accumulation time based on the measured charge flux and, based on the determined target number of charges, modulating a second ion beam produced from the ion source to cause the target number of charges from the second ion beam to be accumulated in the charge accumulation device during the charge accumulation time.

In one example, a pulse frequency modulation technique is utilized to modulate the second ion beam.

In another example, a proportional modulation technique is utilized to modulate the second ion beam.

In one example, the method includes transporting the second ion beam to an ion lens element interposed between the ion source and the charge accumulation device. Modulating the second ion beam includes applying controlled voltage potentials to the ion lens element to deflect the second ion beam by a desired degree off an axis of the ion lens element.

In one example, applying the voltage potentials includes chopping the second ion beam into a number of discrete pulses, and modulating the second ion beam further includes transporting the pulses into the charge accumulation device to cause the target number of charges from the second ion beam to be accumulated in the charge accumulation device during the charge accumulation time.

In another example, applying the voltage potentials includes chopping the second ion beam into a number of discrete pulses. Modulating the second ion beam further includes spreading ions of the pulses apart in time and space to transform the pulses into a continuous ion beam. The continuous ion beam is directed into the charge accumulation device to cause the target number of charges from the second ion beam to be accumulated in the charge accumulation device during the charge accumulation time.

In another example, the degree to which the second ion beam is deflected off the axis corresponds to a percentage of ions of the second ion beam being transported into the charge accumulation device, and modulating the second ion beam further includes transporting the percentage of ions into the charge accumulation device to cause the target number of charges from the second ion beam to be accumulated in the charge accumulation device during the charge accumulation time.

According to another implementation, an ion processing device is provided. The ion processing device includes an evacuable housing having an interior, an ion exit communicating with the interior, an ion guiding device in the interior, at least a portion of the ion guiding device being arranged about an ion beam axis passing through the ion exit, and a device and/or circuitry for deflecting an ion beam by a desired degree off the ion beam axis and away from the ion exit and transferring a target number of charges of the ion beam from the ion guiding device into the ion exit over a fixed charge accumulation time.

According to another implementation, an additional ion containment device is interposed between the ion exit and a charge accumulation device. The deflecting means transfers the target number of charges through the ion exit and into the charge accumulation device over the fixed charge accumulation time via the ion containment device. The ion containment device may be configured to disperse a series of discrete ion packets into a continuous ion beam that is received by the charge accumulation device.

According to another implementation, an ion beam modulator is provided. The ion beam modulator includes a first chamber, a second chamber having an ion exit aperture, an ion guide exit lens interposed between the first chamber and the second chamber, an ion guiding device disposed in the first chamber, and an ion deflecting device disposed in the second chamber between the ion guide exit lens and the ion exit aperture. The ion deflecting device includes at least two ion deflector elements arranged about a nominal ion axis running from the ion guiding device, through the ion exit lens, between the at least two ion deflector elements, and through the ion exit aperture. The ion beam modulator further includes a device and/or circuitry configured to apply controlled voltage potentials respectively to the at least two ion deflector elements to deflect an ion beam passing through the ion deflecting device by a desired degree off the ion axis and transfer a target number of charges of the ion beam through the ion exit aperture over a fixed charge accumulation time.

According to another implementation, an ion processing system is provided. The ion processing system includes a charge accumulation device having an ion entrance aperture and an ion beam modulator communicating with the charge accumulation device via the ion entrance aperture. The ion beam modulator includes a device and/or circuitry for deflecting an ion beam by a desired degree off an ion axis nominally focused toward the ion entrance aperture and transferring a target number of charges of the ion beam from the ion beam modulator into the charge accumulation device via the ion entrance aperture over a fixed charge accumulation time.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION OF THE INVENTION

In general, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

The subject matter disclosed herein generally relates to ionic charge control and associated ion processing. Examples of implementations of methods and related devices, apparatus, and/or systems are described in more detail below with reference to FIGS. 4-12. These examples are described in the context of mass spectrometry. However, any process that involves the control, detection or other processing of ions may fall within the scope of this disclosure. Additional examples include, but are not limited to, vacuum deposition and other fabrication processes such as may be employed to manufacture materials, electronic devices, optical devices, and articles of manufacture.

Figure 4:
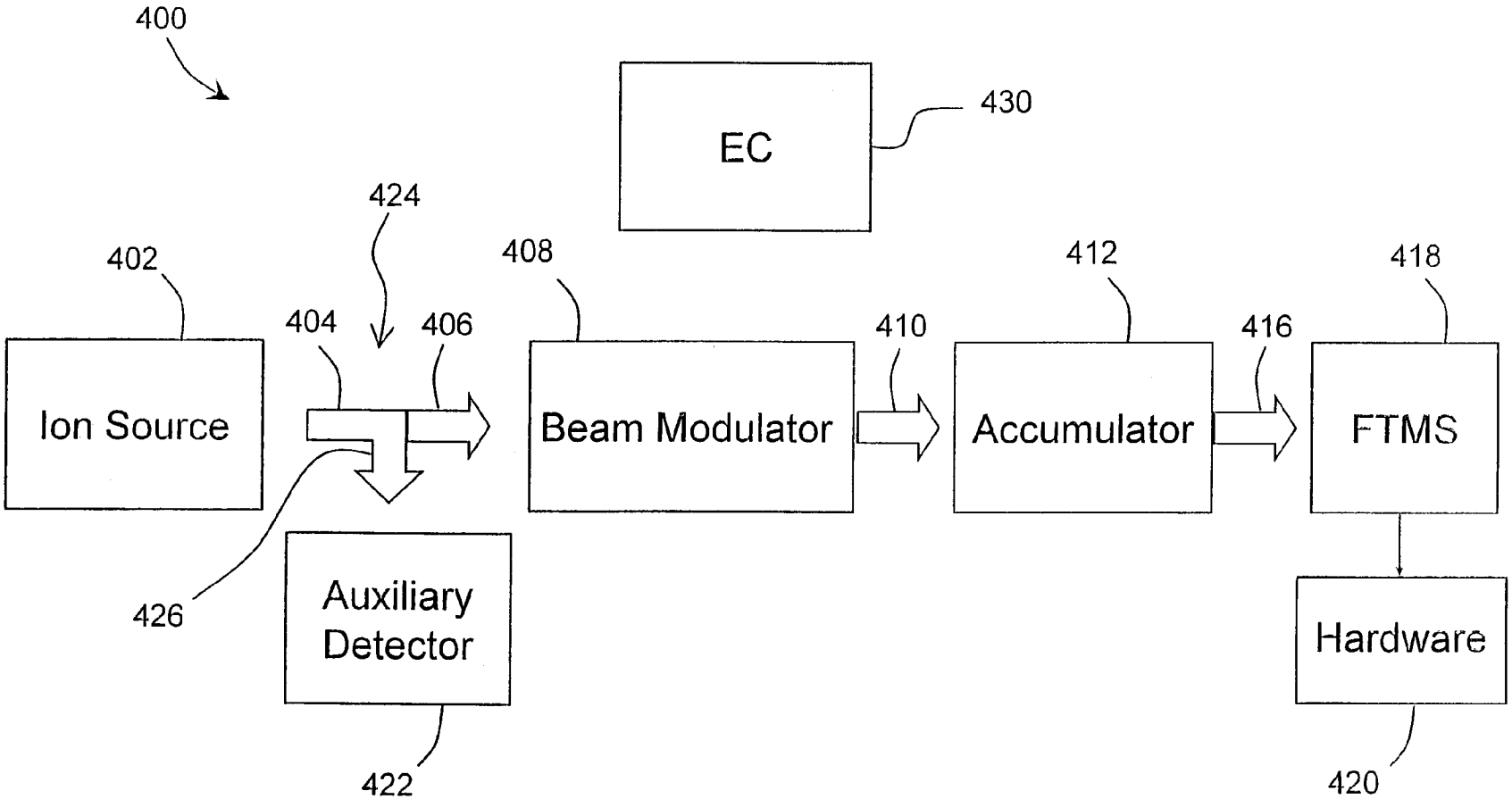
FIG. 4 is a schematic view of an example of a system implementing charge control according to an implementation taught in the present disclosure.

FIG. 4 is a schematic view of an example of a device (or apparatus, assembly, system, etc.) for controlling ionic charge flux according to an implementation of the present disclosure. As used herein, the term "flux" may be defined as the number of charges passing through a plane of a defined area per unit time. FIG. 4 also illustrates an example of an operating environment in which the charge flux controller may be implemented. By way of example, the charge flux controller may be embodied as, or included as part of, a mass spectrometry (MS) system or other type of ion processing system 400. As appreciated by persons skilled in the art, many components of the system 400 may operate at very low pressure or vacuum. For simplicity, the various components required for maintaining such operating conditions (e.g., sealed enclosures, gates, vacuum pumps, etc.) are not shown. Likewise, the various components that may be utilized to control the flow of ions through the system 400 (e.g., ion optics) from one module to another (apart from those described below) are not shown.

Sample material is provided to an ion source 402 by any suitable sample introduction system (not shown). The ion source 402 ionizes a sample material to produce a continuous or pulsed ion beam 404. In some implementations, the ion source 402 may operate at atmospheric pressure and thus be external to the evacuated portions of the system 400, while in other implementations the ion source 402 may be of the type that operates under low-pressure or vacuum conditions. Ions produced by the ion source 402 are transported 406 to an ion beam modulator 408. Detailed examples of the ion beam modulator 408 are described below. As also described below, the ion beam modulator 408 may modulate the charge flux according to various techniques, including pulse frequency modulation and proportional modulation. The ion beam modulator 408 controls the transport of ions 410 and thus the charge flux into an ion accumulator (or charge accumulator) 412. As described below, the ion beam modulator 408 may include means for deflecting the ion beam by a desired degree off an ion axis passing from the ion beam modulator 408 to the ion accumulator 412 via an ion aperture providing communication between these two modules. In this manner, the ion beam modulator 408 is able to transfer a target number of charges into the ion accumulator 412 over a fixed accumulation time, $T_{ac}$. The target number of charges may be, for example, an amount deemed optimal for a particular experiment being performed.

Figure 1:
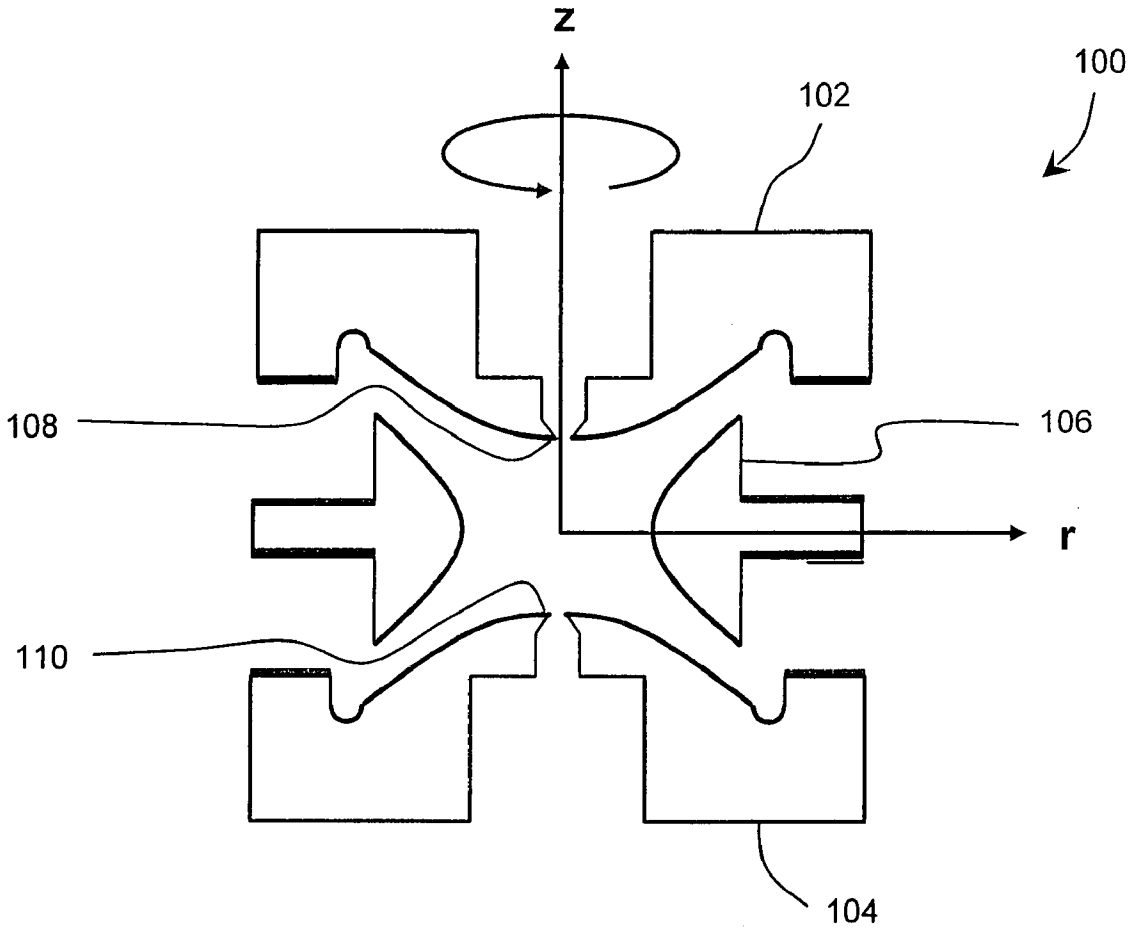
Fig. 1 (Prior Art)
FIG. 1 is a cross-sectional elevation view of a three-dimensional ion trap known in the art.
Figure 2:
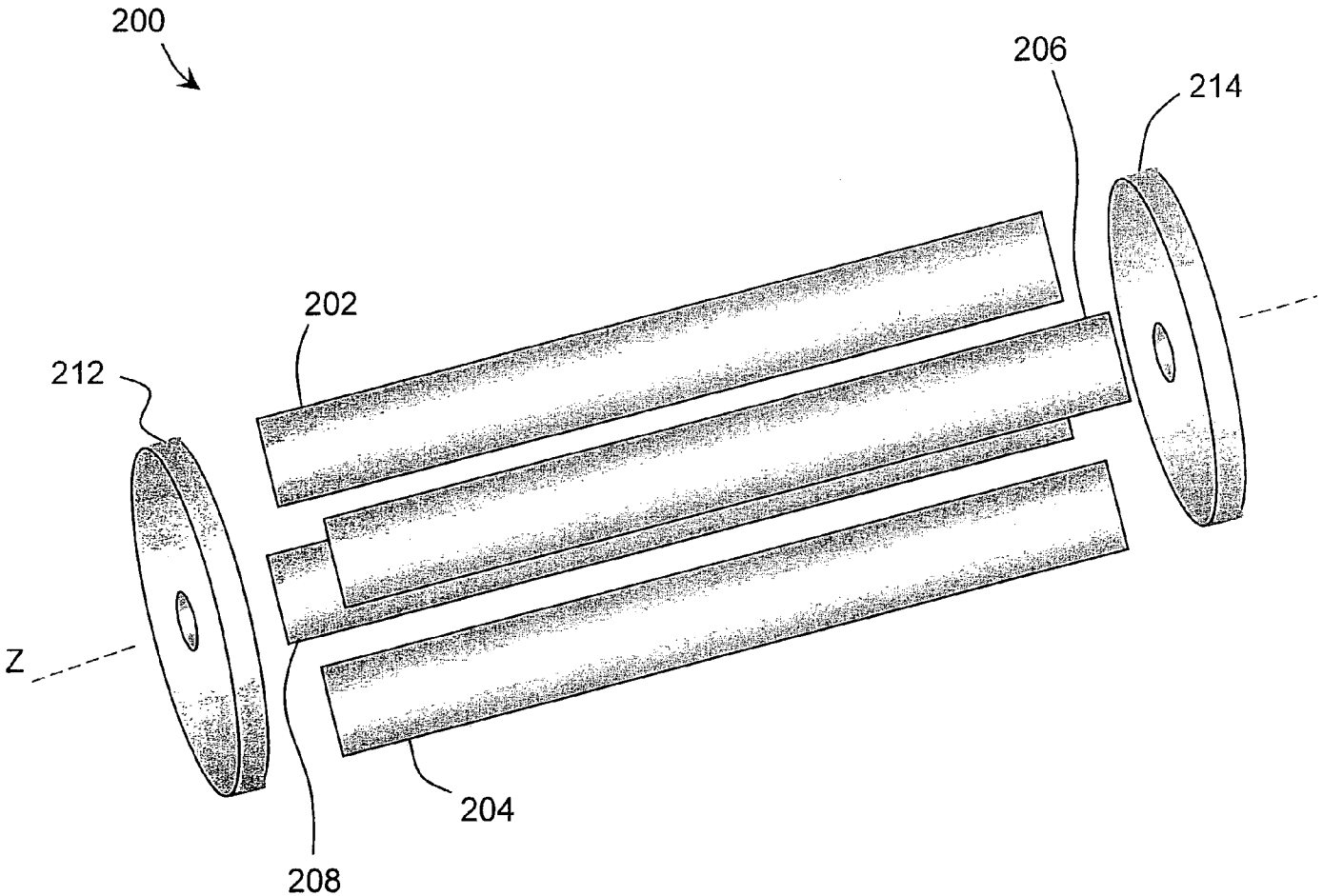
Fig. 2 (Prior Art)
FIG. 2 is a perspective view of a linear ion trap known in the art.
Figure 3:
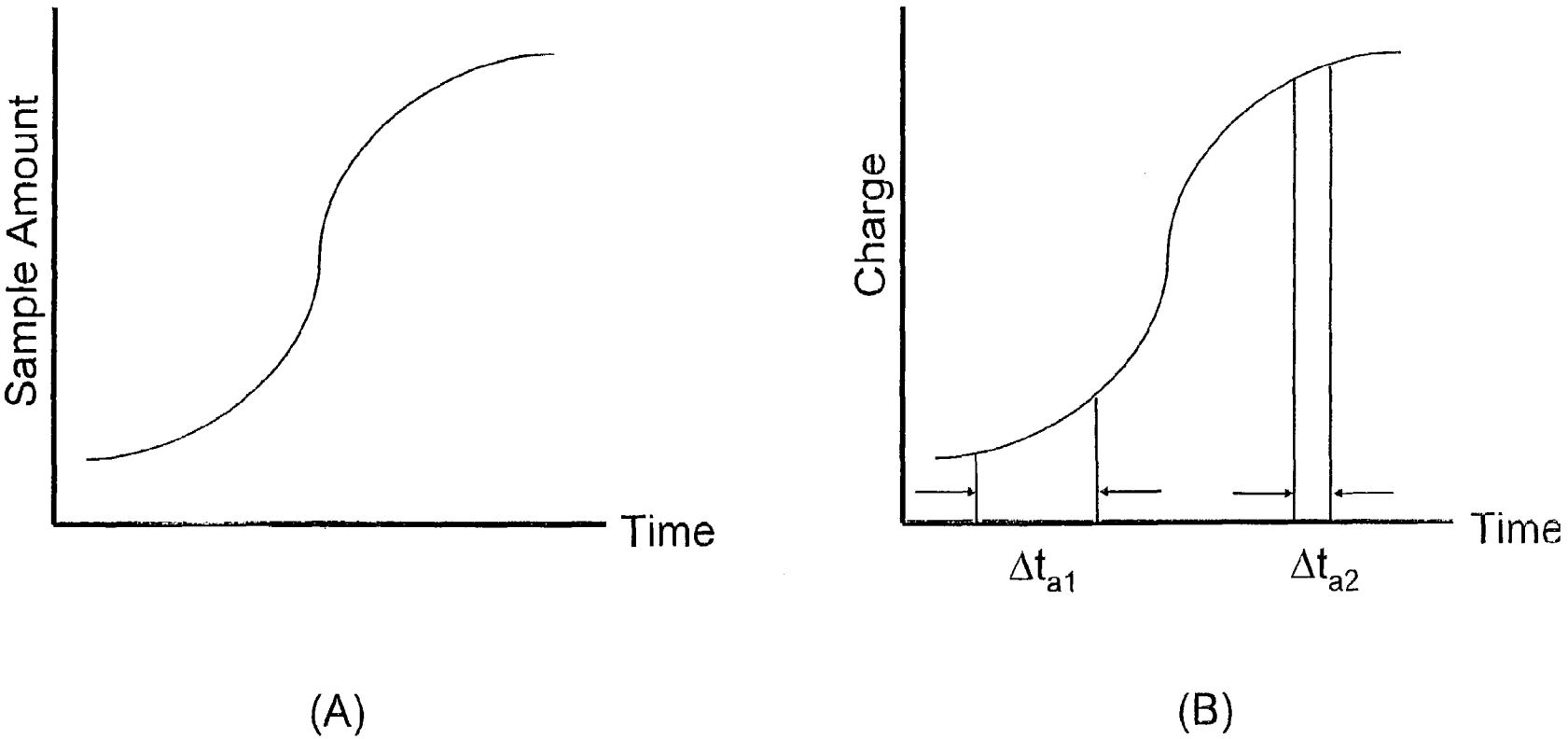
Fig. 3 (Prior Art)
FIG. 3A is a plot of sample amount as a function of time descriptive of a technique for controlling charge accumulation known in the art.
FIG. 3B is a plot of charge as a function of time descriptive of a technique for controlling charge accumulation known in the art.

The ion accumulator 412 may be any device capable of containing ions under controllable conditions such as, for example, an ion trap 100 or 200 as described above and illustrated in FIG. 1 or FIG. 2. The ion accumulator 412 itself may be capable of performing mass analyzing or mass filtering processes. The ion accumulator 412 may be configured to apply electrical fields to ions as in the case of an ion trap 100 or 200 such as illustrated in FIG. 1 or FIG. 2. The ion accumulator 412 may be configured to apply both electrical and magnetic fields such as in the case of, for example, an ion cyclotron resonance (ICR) trap or Fourier Transform Mass Spectrometer (FTMS), or an instrument that includes one or more electrical and magnetic sectors. In some implementations, the ion accumulator 412 may function solely or primarily as a device for accumulating, storing or containing ions in preparation for transporting ions 416 into another ion accumulation or containment device 418. For example, the second ion accumulation or containment device 418 may be configured as a mass analyzer. In one specific example, the second ion accumulation or containment device 418 is provided in the form of an FTMS. As appreciated by persons skilled in the art, such a device 418 generally may include multipole, sector, or other types of electrode structures suitable for implementing their ion processing or manipulating functions.

More generally, the device 418 may be structured as a continuous-beam device (e.g., multipole device, time-of-flight (TOF), electric or magnetic sector) or a time-sequenced device (e.g., ion trap, FTMS). Moreover, the system 400 may be capable of performing hyphenated techniques such as tandem MS or MS/MS, in which case more than one mass analyzer (and more than one type of mass analyzer) may be used. As one example, an ion source may be coupled to a multipole or sector structure that acts as a first stage of mass separation to isolate molecular ions of a mixture. The first analyzer may in turn be coupled to another multipole structure (normally operated in an RF-only mode) that performs a collision-focusing function and is often termed a collision chamber or collision cell. A suitable inert collision gas such as argon or nitrogen is injected into the collision cell to cause fragmentation of the ions and thereby produce daughter ions. This second multipole structure may in turn be coupled to yet another multipole or sector structure that acts as a second stage of mass separation to scan the daughter ions. Finally, the output of the second stage is coupled to an ion detector.

The system 400 may include one or more ion detectors. The ion detector(s) may be configured and located relative to other devices of the system as needed for measuring ions as part of performing pre-analytical scans (pre-scans) for space-charge control, as well as analytical scans for producing mass spectral data. For example, the ion detector may be utilized to measure the magnitude of the charge flux produced by the ion source 402. The ion detector(s) may be external to the ion accumulation devices 412 and/or 418 and receive ions ejected from such devices 412 and/or 418 or may be integrated with such devices 412 and/or 418. As one example, an ion accumulation device 412 or 418 may be configured as an ion trap and capable of ejecting ions to an external electron multiplier, photo-multiplier, Faraday cup, or the like. The ion detector may be associated with an additional mass analyzer for providing mass scanning functionality. In the operation of a typical external ion detector, a stream of ions is focused towards the ion detector by an appropriately applied (and typically fixed) acceleration or bias voltage. The ion detector converts the ions into an electrical current proportional to the intensity of the received (detected) ion current. The electrical current resulting from the ion-to-electron conversion is amplified and transmitted to other electronics for further processing as needed to measure charge flux, generate mass spectra, etc. As other examples, an ion accumulation device 412 and/or 418 such as an FTMS may be configured to measure charge flux by detecting image currents generated in one or more of its electrodes, or measuring power absorbed by an electric field during resonance conditions. In all such cases, the system 400 may be configured to process the resulting electrical current outputted from the ion detector as needed to produce a mass spectrum, which may entail processing/conditioning by a signal processor, storage in memory, and presentation by a readout/display means. Typically, a mass spectrum is a series of peaks indicative of the relative abundances of the detected ions as a function of mass-to-charge ratio. A trained analyst can then interpret the mass spectrum to obtain information regarding the sample material processed by the system 400. In the example illustrated in FIG. 4, ion signal processing hardware 420 communicates with the ion accumulation device 418. The system 400 may also include an auxiliary ion detector 422 "downstream" of the ion source 402 and "upstream" of the ion beam modulator 408. An ion deflection device 424 of suitable design may be operated to direct ions 426 produced from the ion source 402 to the auxiliary ion detector 422.

The system 400 may further include a suitable analog or digital electronic controller 430 that controls one or more of the components described above. For simplicity, signal communication lines to and from the electronic controller 430 are not shown. As examples, the electronic controller 430 may control the timing and operating parameters of RF, AC and DC signals transmitted to one or more of these components as well as provide an interface for user input and programming. As appreciated by persons skilled in the art, the electronic controller 430 may have hardware and/or software attributes and may represent one or more control modules that are programmable general-purpose devices and/or devices having functionality dedicated for controlling or interfacing with specific components of the system 400.

In some implementations, the system 400 may further include an ion containment structure (not specifically shown), such as for example a multipole ion guide, axially located between the beam modulator 408 and the ion accumulator 412. As described further below, this additional ion containment structure may be utilized to disperse packets of ions produced by the beam modulator 408 into a continuous ion beam that is then directed into the ion accumulator 412.

In one example of operating the system 400, the first ion accumulation device 412 illustrated in FIG. 4 operates primarily as an ion accumulator and the second ion accumulation device 418 operates as a mass analyzer. A method is provided for controlling the charge to be accumulated in the ion accumulation device 412 and subsequently transferred into the mass analyzer 418. According to this method, the ion source 402 is operated to produce an ion beam 404. A pre-scan of relatively short duration is performed to obtain an estimate of the charge flux from the ion source 402. The pre-scan may be performed by deflecting 426 the ion beam from the ion source 402 into the auxiliary ion detector 422 for a fixed period of time, $\Delta t_{pre}$, for measurement of the charge flux. Alternatively, the ion beam may be directed through the ion beam modulator 408 without modulation and into the ion accumulation device 412. The ion accumulation device 412 is then operated to eject ions into an ion detector (not shown) associated with the ion accumulation device 412. As a further alternative, the ion beam may be directed through the ion beam modulator 408 without modulation and into the ion accumulation device 412. Ions are allowed to accumulate in the ion accumulation device 412 for the fixed time, $\Delta t_{pre}$, and subsequently are transferred into the mass analyzer 418 for measurement. In any of these cases, after measuring the charge flux from the ion source 402, a calculation is made to determine a target number of charges, $T_v$, to be accumulated in the ion accumulator 412 during a subsequent analytical scan. The target number of charges may depend on a number of factors, including the type of analytical experiment being performed on the sample material, the known or suspected composition or chemical structure of the sample material, etc. Generally, the target number of charges is a number that will optimize the sample analysis according to one or more factors. For example, one goal of the optimization may be to provide high sensitivity and mass resolution while eliminating adverse space-charge effects or at least reducing space-charge effects to a level acceptable for the analysis. In turn, the target number of charges to be accumulated determines the degree of modulation of the ion beam during the subsequent analytical scan. The degree of modulation dictates how the ion beam modulator 408 will be operated during the analytical experiment.

After the pre-scan has been performed and the degree of modulation has been determined, the ion source 402 is operated to produce a second ion beam. The second ion beam is modulated by the ion beam modulator 408 according to the above-described calculations or determinations. The ion beam modulator 408 modulates the ionic charge flux of the second ion beam such that ions are allowed to enter the ion accumulation device 412 over a predetermined, fixed charge accumulation time, $T_{ac}$. The fixed accumulation time, $T_{ac}$, or the period during which the ion accumulation device 412 is "open" to accumulate charge, may be determined by the charge capacity of the ion accumulation device 412. The charge capacity may depend on a number of physical and operational factors, as appreciated by persons skilled in the art (e.g., device geometry, diameter, length, applied signal frequency, RF voltage, etc.). The fixed accumulation time $T_{ac}$ may also be determined by the charge flux. For example, if the charge flux is too low, then even a 100% duty cycle for the ion beam modulator 408 may not produce enough charge for a given accumulation time $T_{ac}$. In this case, the accumulation time would need to be increased.

At the end of this charge accumulation time, the target number of charges $T_v$ will have been accumulated in the ion accumulation device 412. The ion accumulation device 412, if configured to perform mass analysis, may then be operated to conduct an analytical scan on the accumulated ions according to a desired experiment. Alternatively, the ion accumulation device 412 may be operated to transport the accumulated ions into the mass analyzer 418, which then performs the desired analytical scan.

Figure 5:
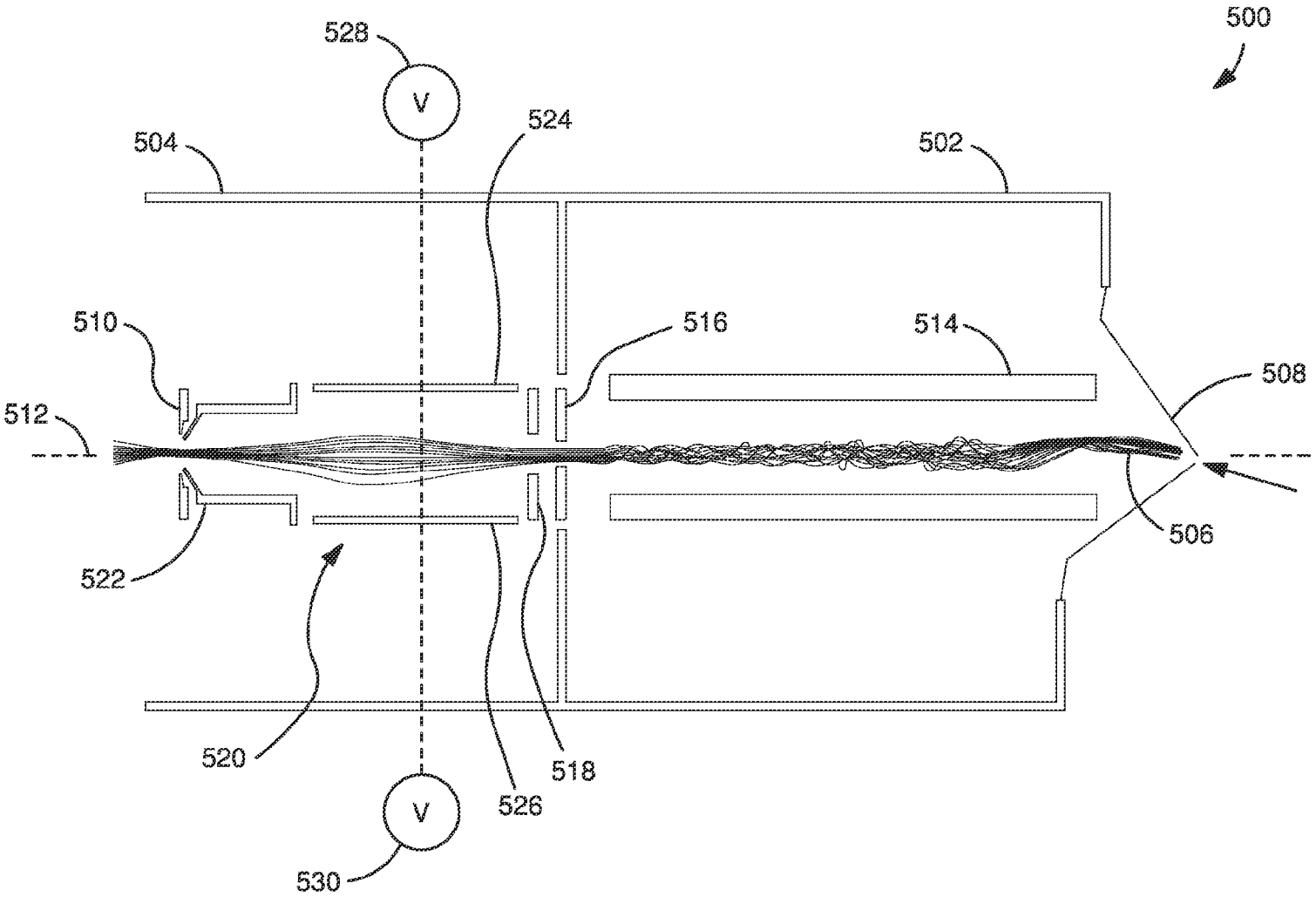
FIG. 5 is a cross-sectional schematic view of an example of an ion beam modulator according to an implementation taught in the present disclosure.
Figure 6:
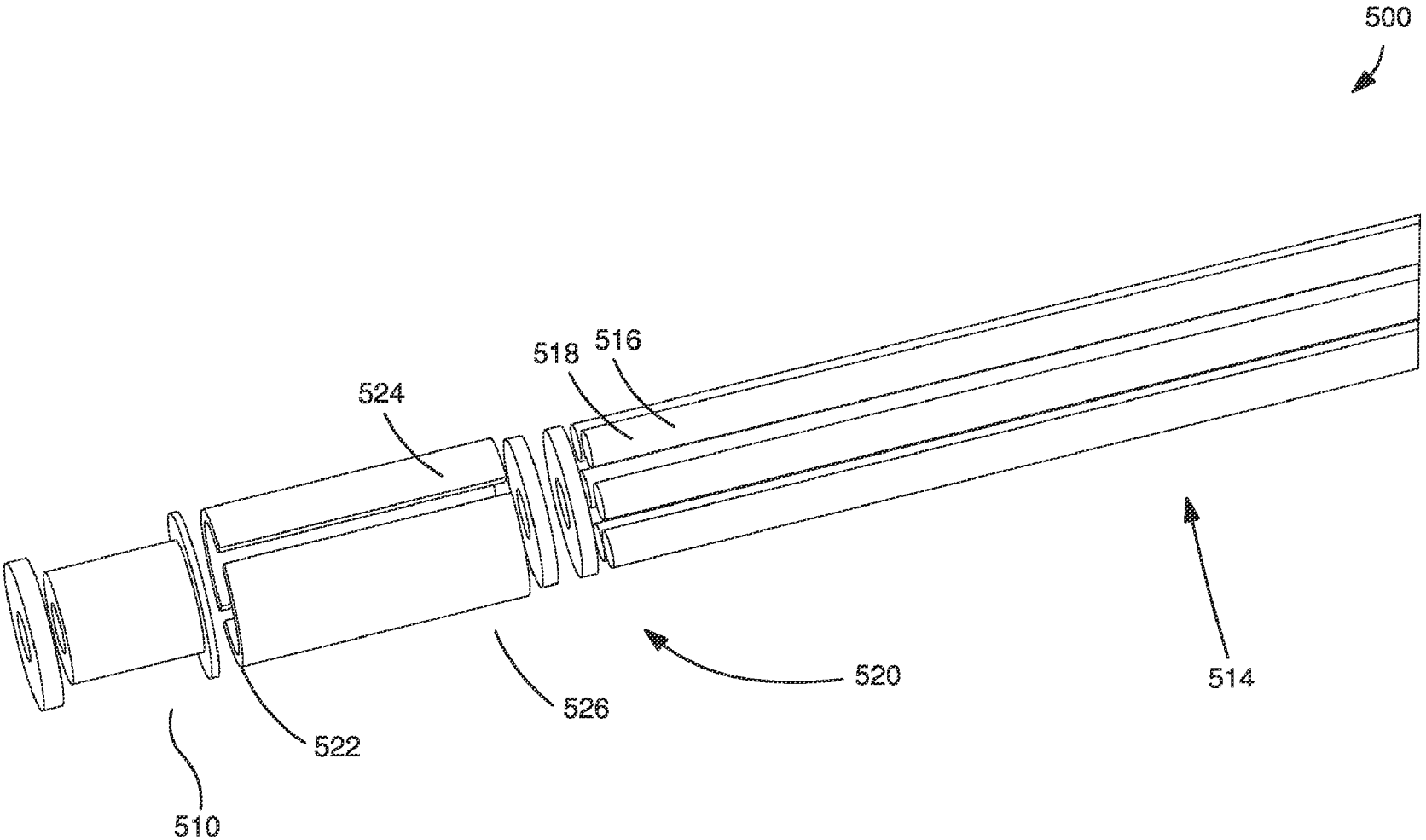
FIG. 6 is a perspective view of an example of an ion beam modulator according to an implementation taught in the present disclosure.
Figure 7:
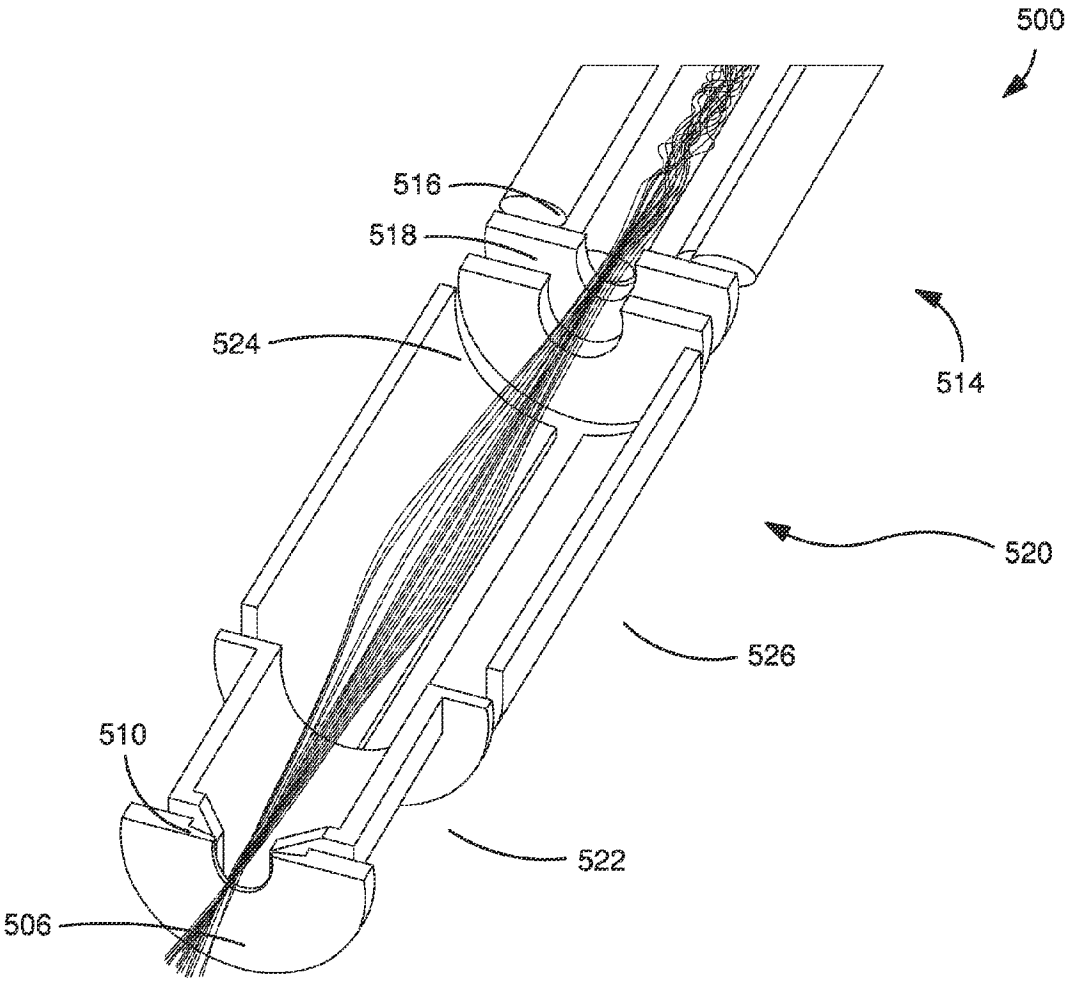
FIG. 7 is a perspective cut-away view of an example of an ion beam modulator according to an implementation taught in the present disclosure.
Figure 8:
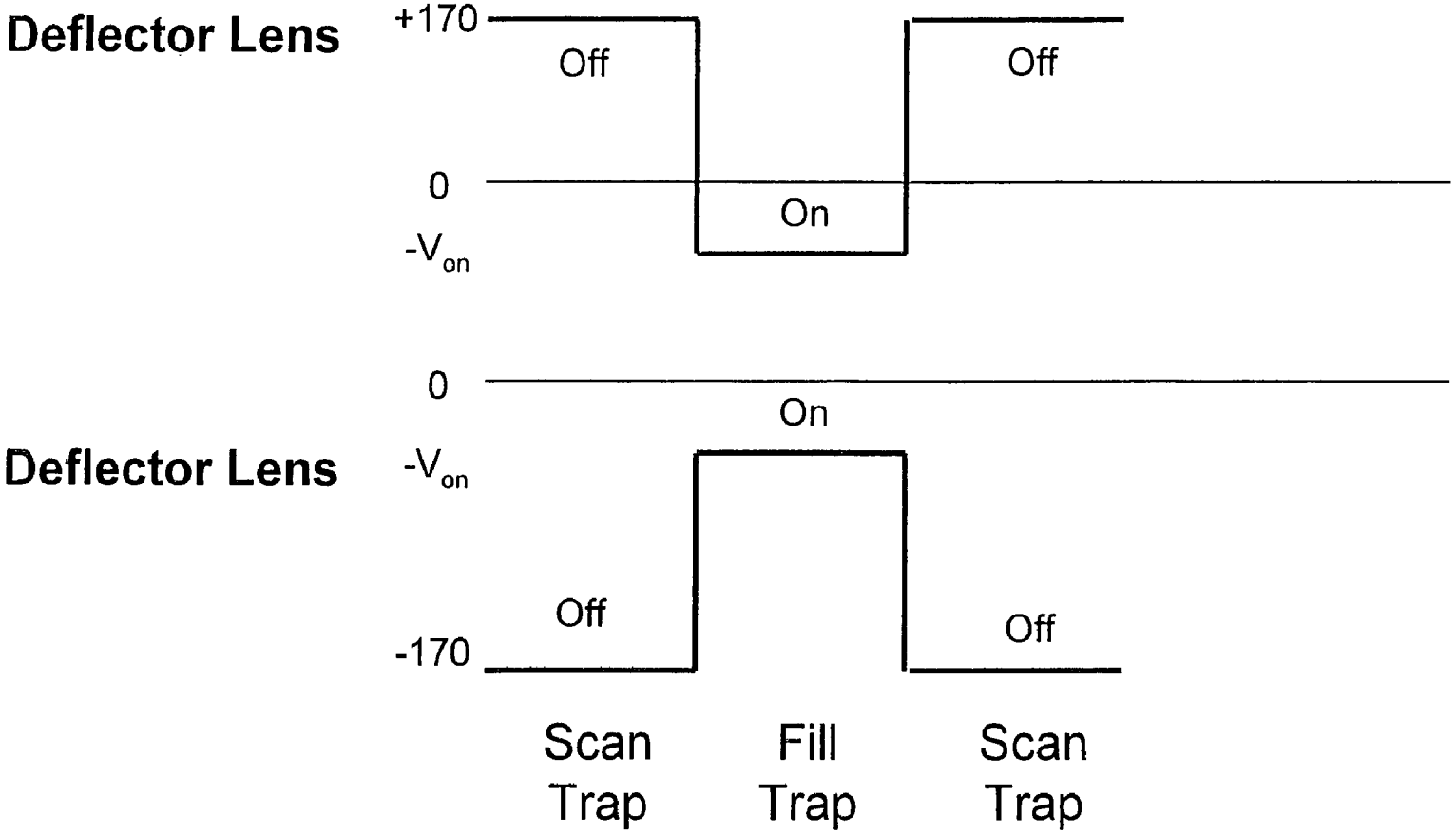
FIG. 8 is a plot of deflector voltages over time illustrating an example of a pulse frequency modulation technique taught in the present disclosure.

FIG. 5 is a cross-sectional schematic view of an example of an ion beam modulator 500 in accordance with teachings of the present disclosure. FIG. 6 is a perspective view of the ion beam modulator 500 showing three-dimensional features of this example. FIG. 7 is another perspective view of the ion beam modulator 500 that is cut away to show electrode shapes.

In this example, the ion beam modulator 500 includes a first vacuum chamber 502 and a second vacuum chamber 504. An ion beam 506 produced by an ion source is admitted into the first vacuum chamber 502 via a suitable ion inlet 508 such as a skimmer plate. The ion beam modulator 500 communicates with an ion entrance aperture 510 of an ion accumulation device. Thus, an ion path is defined generally along an ion axis 512 through the ion inlet 508, the first vacuum chamber 502, the second vacuum chamber 504, and the entrance aperture 510. The entrance aperture 510 of the ion accumulation device may also be considered as being the ion exit of the ion beam modulator 500, or a combination of a modulator exit, an accumulator entrance and an intermediary ion transport structure (e.g., a capillary), etc.

The first vacuum chamber 502 may include an ion guide 514 such as, for example, a hexapole rod arrangement elongated along the ion axis 512. The boundary between the first vacuum chamber 502 and the second vacuum chamber 504 includes an ion guide exit lens 516 arranged about the ion axis 512. The ion guide 514 transports ions from the inlet 508 to the ion guide exit lens 516 utilizing AC (RF) or AC and DC voltage potentials as appropriate. The ion guide exit lens 516 extracts the ions from the ion guide 514 and also serves to limit gas flow into the next vacuum chamber 504.

The second vacuum chamber 504 may include an ion guide focus lens 518, an ion deflector lens 520, and an entrance lens 522 that function together to focus the ion beam 506 into the entrance aperture 510 of the ion accumulation device. Each of the ion guide focus lens 518, ion deflector lens 520, and entrance lens 522 may have cylindrical rotational symmetry about the ion axis 512. In some implementations, the ion deflector lens 520 includes at least two physically separate ion deflector elements 524 and 526. In the illustrated example, the ion deflector lens 520 is split into two cylindrical halves 524 and 526 along the axis of symmetry 512. As schematically depicted by respective voltage sources 528 and 530, the voltage potentials applied to the ion deflector elements 524 and 526 are independently controllable.

As appreciated by persons skilled in the art, the other ion optics components may be connected to voltage sources (not shown) as needed to perform their respective functions. As also appreciated, the ion path and associated axis 512 need not be uniformly straight throughout the entire extent of the ion beam modulator 500; FIG. 5 is but one example of how the various ion optics components may be arranged relative to each other. The ion axis 512 represents the general or nominal (non-deflected) direction of ion travel from ion inlet 508, through the various components of the ion beam modulator 500, and to the entrance aperture 510.

The ion deflector lens 520 functions to deflect the ion beam 506 by a desired degree off-axis to modulate the ion beam 506 and thereby control the charge flux passing through the entrance aperture 510 into the ion accumulation device. By controlling the charge flux in this manner, the number of ions (and thus charges) entering the ion accumulation device in a fixed ion (charge) accumulation time may likewise be controlled. For instance, when both ion deflector elements 524 and 526 of the ion deflector lens 520 are at the same voltage potential and polarity (e.g., when both elements are at ±30 V, depending on the polarity of the ions), the ion deflector lens 520 serves as an ion focusing lens. In this case, the ion beam 506 is not deflected or, stated in another way, the degree or amount of deflection or modulation is zero and ions from the ion beam 506 are not prevented from entering the entrance aperture 510. On the other hand, when the ion deflector elements 524 and 526 are set to large enough voltage potentials of opposite polarity (e.g., +170 V and −170 V), then ions are deflected off the axis of focus 512 and away from the entrance aperture 510 to such a degree that all ions are prevented from entering the entrance aperture 510. The foregoing two operating conditions may be implemented to operate the ion deflector lens 520 as an ion gate that controls ion flow (and thus charge flux) into the entrance aperture 510 in an ON/OFF fashion, as further illustrated in FIG. 8. This type of operation is useful for implementing pulse frequency modulation as described further below. Between the two "ON" and "OFF" settings, the magnitudes and polarities of the voltage potentials applied to the ion deflector elements 524 and 526 may be set to deflect the ion beam 506 to a degree that causes some desired percentage of ions to pass through the entrance aperture 510 while preventing the remaining ions from passing through. This latter mode of operation is useful for implementing proportional modulation, as also described further below.

As noted earlier in this disclosure, in some implementations the aperture 510 is the ion exit of the ion beam modulator 500 and communicates with an ion containment device (not shown) of a desired axial length. This ion containment device in turn communicates with the entrance aperture of the ion accumulation device. Such an intermediary ion containment device may be structured as a multipole (quadrupole, hexapole, etc.) ion guide and have a schematic cross-section similar to the illustrated first vacuum chamber 502 and corresponding ion guide 514. Thus, for example, this ion containment device may include a set of axially elongated electrodes between an entrance aperture and an exit aperture. The entrance aperture of the ion containment device may correspond to the ion exit 510 of the ion beam modulator 500 or may be positioned at an axial distance from the ion exit 510. Likewise, the exit aperture of the ion containment device may correspond to the entrance aperture of the ion accumulation device or may be positioned at an axial distance from the entrance aperture of the ion accumulation device. In use, the ion containment device may be provided particularly in connection with pulse frequency modulation. The packets of ions created by the ion beam modulator 500 are directed into the ion containment device. Through the effects of collisions with damping gas and flight time, ion packets traveling through the ion containment device are dispersed in time and space. As a result, a series of discrete ion packets of equal intensity and charge density is transformed into a continuous ion beam of uniform intensity, which is then directed into the ion accumulation device. For this purpose, AC, RF and/or DC signals may be applied as needed to control the excursions of the ions through the ion containment device. The damping gas may be supplied from back leakage from the ion accumulation device due a pressure differential. Alternatively, a flow of damping gas may be injected directly into the ion containment device. The ion containment device may be structurally separated from the preceding ion beam modulator 500 to maintain a low-pressure environment in the ion beam modulator 500 so that the trajectories and kinetic energies of the ions undergoing modulation are not detrimentally affected by collisions with damping gas.

To implement pulse frequency modulation, the ion deflector electrodes are operated (FIG. 8) to modulate the ion beam by alternately deflecting the ion beam toward and away from the entrance aperture 510 of the accumulator cell. In effect, the modulator cell chops the charge flux of the continuous ion beam into a sequence of discrete time packets, or ion packets each having a period of time, $\Delta t_{ac}$ that determines the frequency of the pulsing. In this manner, the charge spreads out in time and space due to the different mass in the ion beam. The result is a quasi-continuous ion beam that enters the accumulator over a predetermined, fixed charge accumulation time, $T_{ac}$, for example 500 ms. Accumulating a target number of charges in the accumulator cell thus entails transferring a certain number of ion packets through the entrance aperture 510 of the accumulator cell over the fixed charge accumulation time $T_{ac}$. For example, if the ion beam 506 is chopped into a series of pulses with a fixed pulse width of 50 microseconds, then the duty cycle can be varied from one pulse per accumulation period (50 microsecond pulse in 500 milliseconds period) for a 0.01% duty cycle to a maximum of 10,000 pulses, of 50 microsecond duration, per accumulation period for a 100% duty cycle.

Figure 9:
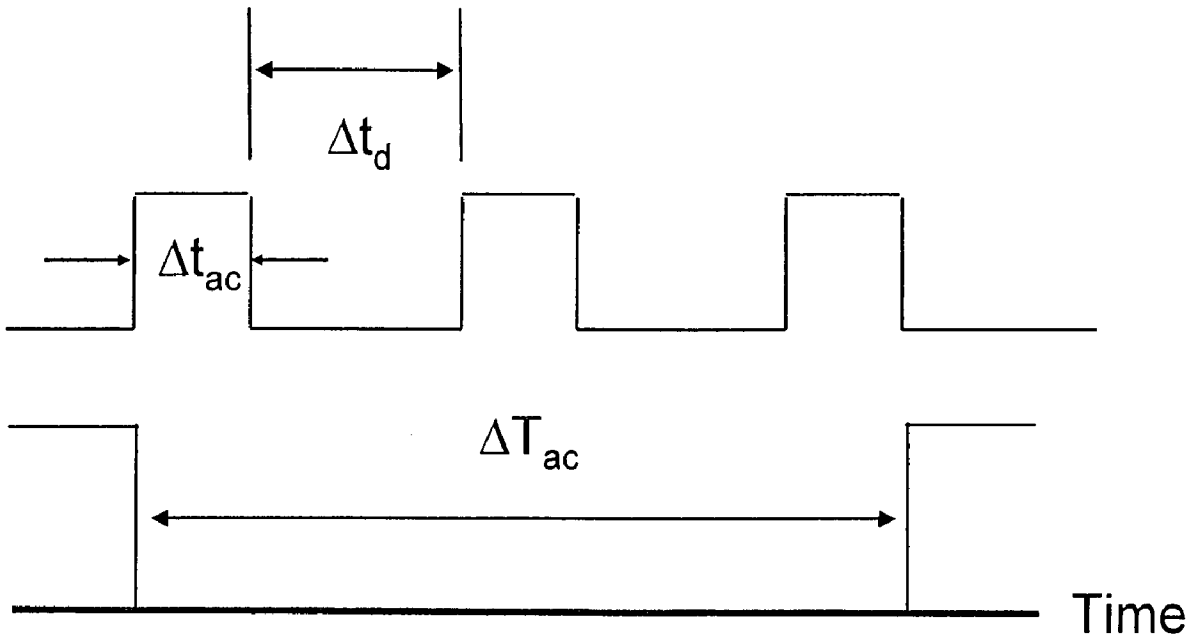
FIG. 9 is a plot of ion pulses over time illustrating an example of a pulse frequency modulation technique taught in the present disclosure.

FIG. 9 shows a representative time diagram for this process. The charge collected, $Q_{pre}$ (measured in units of coulombs), during a pre-scan time, $\Delta t_{pre}$, is given by:

$$Q_{pre}=(\Delta t_{pre})(\Psi)(C), \quad \text{Eqn. 1}$$

where (C) is the sample concentration (ions/cm$^3$) entering the ionization source, and ($\Psi$) is a constant (coulombs-cm$^3$)/(seconds-ions) relating to the ionization efficiency of the ion source and the ion detector efficiency. Similarly the charge collected, $Q_{anal}$, during an analytical scan time, $\Delta t_{anal}$, is given by:

$$Q_{anal}=(\Delta t_{anal})(\Psi)(C). \quad \text{Eqn. 2}$$

If a particular amount of charge is desired to be accumulated in the ion accumulator and subsequently transferred into a mass analyzer, the charge, $Q_{anal}$, can be represented by the "target" value $(T_v)=Q_{anal}$. The total time, $\Delta t_{anal}$, during the accumulation period of the analytical scan in which ions are allowed into the accumulator is the sum of the individual time packets $\Delta t_{ac}$, and is thus given by:

$$\Delta t_{anal}=N(\Delta t_{ac}), \quad \text{Eqn. 3}$$

where the number of pulses (or modulator frequency) N=1, 2, 3, . . . $N_{max}$, and $N_{max}=T_{ac}/\Delta t_{ac}$.

From Eqns. 1, 2 and 3, $$Q_{pre}/T_v=\Delta t_{pre}/(N\Delta t_{ac}), \text{ or } N=(\Delta t_{pre}/\Delta t_{ac})(T_v/Q_{pre}). \quad \text{Eqn. 4}$$

The pre-scan charge $Q_{pre}$ is a measured value. The remaining parameters are set by the user, thus allowing the calculation of N. The time between pulses shown in FIG. 9 can then also be calculated, and is given by:

$$(T_{ac}-N\Delta t_{ac})/(N-1)=\Delta t_d. \quad \text{Eqn. 5}$$

In the case that the pre-scan ion detector is different than the analytical scan detector, then:

$$Q_p=(\Delta t_{pre})(\Psi')(C), \quad \text{Eqn. 6}$$

where (C) is the sample concentration entering the ionization source, and ($\Psi'$) is a constant relating to the ionization efficiency of the ion source and the pre-scan ion detector efficiency. If a particular charge is desired to be accumulated in the accumulator and subsequently transferred into a mass analyzer, the charge, $Q_{anal}$, can be represented by the "target" value $(T_v)=Q_{anal}$. From Eqns. 1 and 6:

$$Q_{pre}/T_v=(\Psi')\Delta t_{pre}/((\Psi)N\Delta t_{ac}), \text{ or} \quad \text{Eqn. 7}$$

$$Q_{pre}/T'_v=\Delta t_{pre}/(N\Delta t_{ac}), \text{ where} \quad \text{Eqn. 8}$$

$$T'_v=(\Psi')T_v/(\Psi). \quad \text{Eqn. 9}$$

Therefore, $$N=(\Delta t_{pre}/\Delta t_{ac})(T'_v/Q_{pre}). \quad \text{Eqn. 10}$$

Thus, using a different ion detector for the pre-scan simply changes the target value by a constant scaling factor. The control of a predetermined charge collected in the ion accumulator while the charge flux from the ion source is changing, due to a change in sample amount, can be effected by: (1) setting the values of $(T_v)$, $(\Delta t_{pre})$, and $(\Delta t_{ac})$ for the pre-scan; (2) measuring $Q_{pre}$ resulting from the pre-scan; (3) calculating N from Eqn. 4 or 10; and (4) calculating $(\Delta t_d)$ from Eqn. 5.

The modulator "ON" time $(\Delta t_{ac})$ may be set with an electronic timer by any suitable means known in the art. Likewise, the calculated delay time $(\Delta t_d)$ before the next "ON" pulse, as well as the total number of pulses (N), may be controlled by any suitable means known in the art.

The measured ion abundance at a particular mass, $I_m$, is not a direct measure of the ion flux from the ion source but can subsequently be scaled to a value representative of the unmodulated ion beam exiting the ion source:

$$I_{ms}=I_m(T_{ac}/N\Delta t_{ac}). \quad \text{Eqn. 11}$$

A single modulation pulse $(\Delta t_{ac})$ of duration 50 microseconds will start an ion packet traveling into the ion accumulator. In the time period of the pulse, an ion of mass-to-charge ratio 100 and an energy of 4 eV will travel a distance of 138 mm, while an ion of mass-to-charge ratio 1000 will travel a distance of 44 mm. Thus, the typical ion packet comprising a distribution of ions of various mass-to-charge ratios will spread in space within the time of a single pulse so as to further spread out the charge in space and further reduce the unwanted effects of space charge. If (N) pulses occur within the accumulation time $(T_{ac})$, the time of flight spreading of the ion packet will result in a uniform distribution of charge along the axis of the ion accumulator and therefore a constant charge density along the axis. Maintaining a constant charge flux out of the modulator cell and entering the accumulator cell prevents space charge variations due to changes in the ion flux from the ion source due to changes in sample amount, which prevents changes to the resonant frequencies of ions, thus preventing the unwanted, deleterious effects of secular frequency shifts due to changes in space charge.

In accordance with further teachings of the present disclosure, an alternative to pulse frequency modulation is proportional modulation. Proportional modulation modulates the charge flux by deflecting the ion beam off the axis of the entrance aperture so as to proportionally reduce the charge flux entering the accumulator. Proportional modulation will now be described with reference to FIGS. 10A-10E and 11.

Figure 10B:
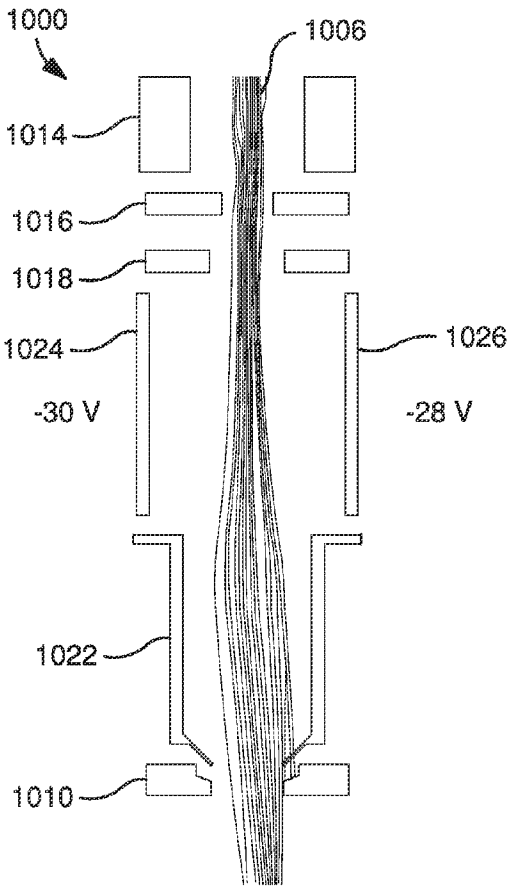
FIGS. 10A-10E are cross-sectional views of an example of an ion beam modulator according to an implementation taught in the present disclosure, subjected to differing combinations of deflector voltages according to an example of a proportional modulation technique taught in the present disclosure.
Figure 10A:
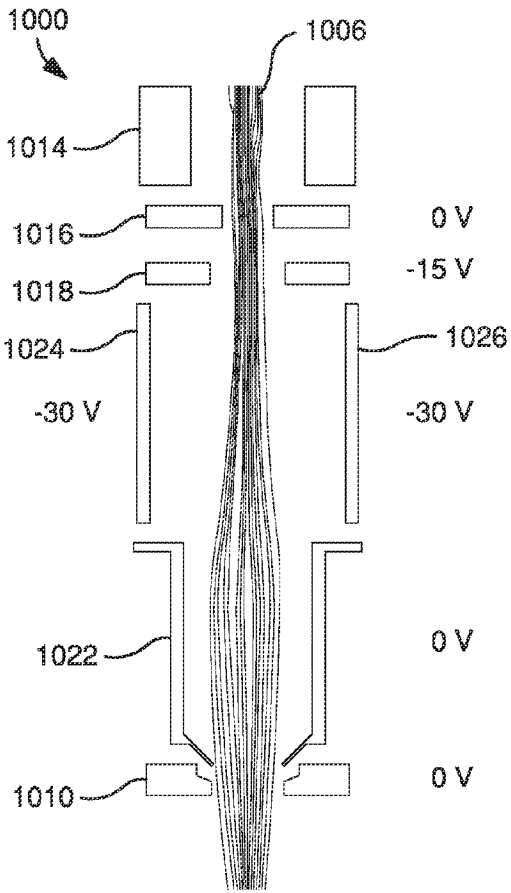
Figure 10D:
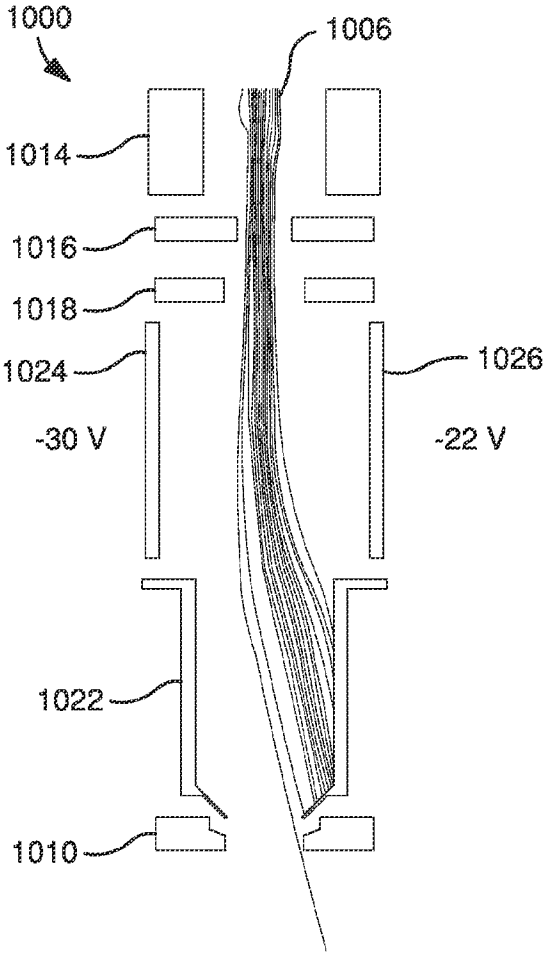
Figure 10C:
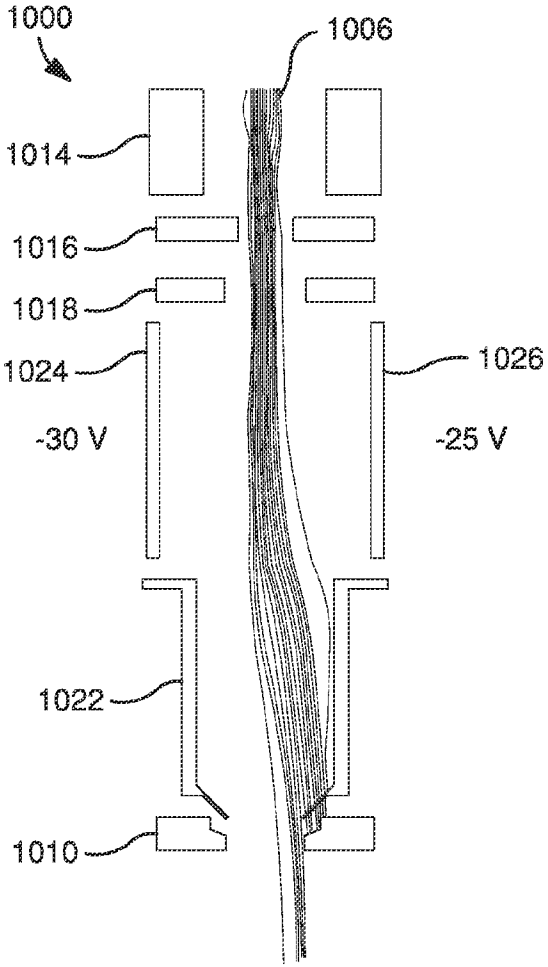
Figure 10E:
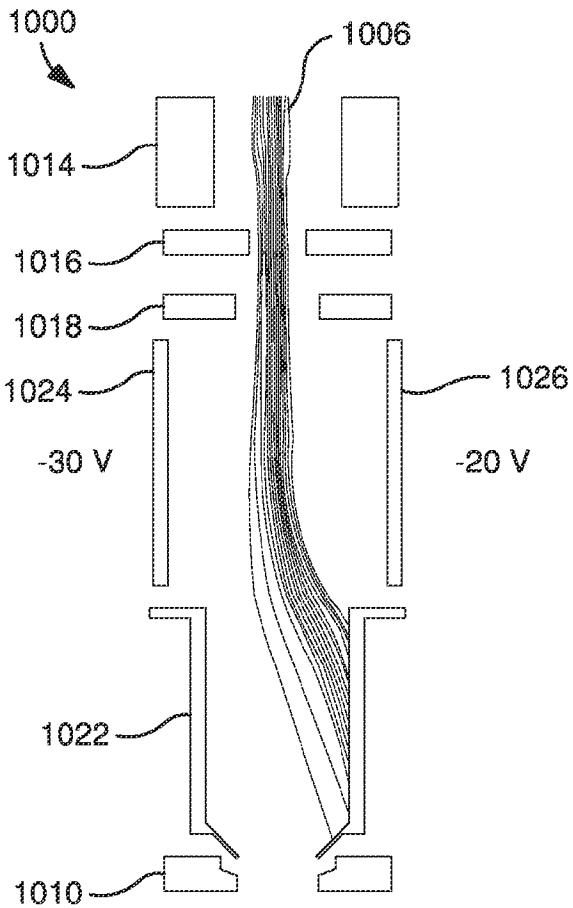

FIGS. 10A-10E illustrate an ion beam modulator 1000 that may be configured similarly to that illustrated in FIG. 5, and accordingly like reference numerals designate like components. Specifically, FIGS. 10A-10E illustrate typical voltage potentials being applied to various ion optics components of the ion beam modulator 1000, including various deflector voltages being applied to the ion deflector elements 1024 and 1026 at different times. It will be understood that the actual values given for voltages are given by way of example only and not as limitations. In each of FIGS. 10A-10E, the one ion deflector lens 1024 is held constant at 30 V while the opposing ion deflector lens 1026 is varied over the voltages indicated. Thus, in FIG. 10A, both ion deflector lenses 1024 and 1026 are at −30 V so that all negative ions (and thus all charges) of the ion beam 1006 are focused along the axis and all ions (charges) pass through the entrance aperture 1010. In FIGS. 10B, 10C and 10D, the voltage potential applied to "right" ion deflector lens 1026 (from the perspective of the drawing figure) successively differs from the −30 V potential applied to the other ion deflector lens 1024 to cause successive degrees of deflection of the ion beam 1006 generally in the direction of the "right"-positioned optics components. FIGS. 10B, 10C and 10D depict operational states of the ion deflector lenses 1024 and 1026 that result in a desired fraction or percentage of ions (charges) passing through the entrance aperture 1010 while the remaining ions are prevented from doing so. In FIG. 10E, the voltage potentials on the ion deflector lenses 1024 and 1026 have been selected to cause all ions to be deflected off axis to a degree that prevents any (or at least most) of the ions from passing through the entrance aperture 1010.

Figure 11:
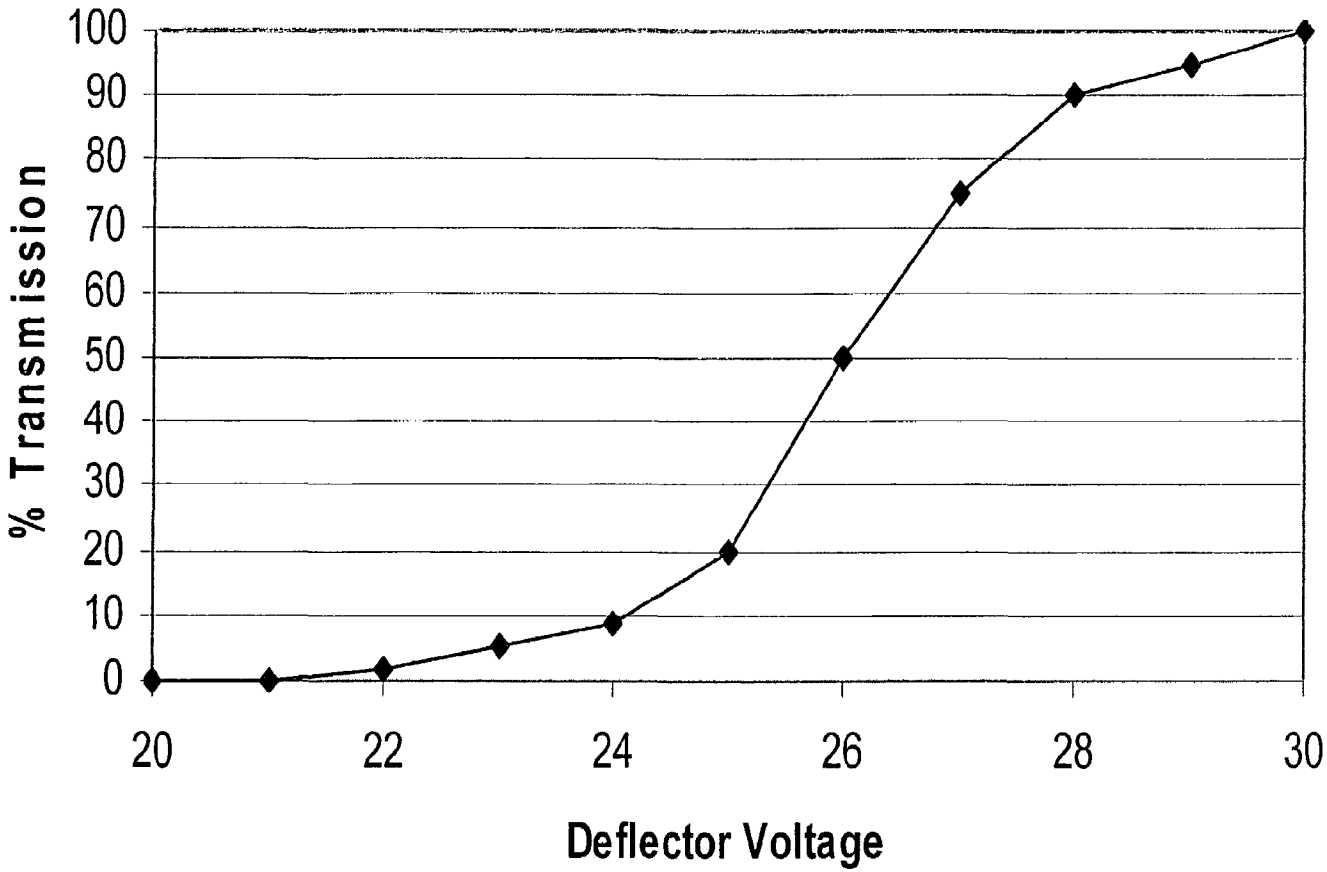
FIG. 11 is a plot of percentage of ion transmission as a function of deflector voltage illustrating an example of a proportional modulation technique taught in the present disclosure.

FIG. 11 shows a plot of the variable deflector voltage verses the percentage of ions passing through the entrance aperture. The ion trajectories of 100 ions of various initial conditions were calculated using SIMION ver. 7.0. A calibration of the modulator transmission vs. deflector voltage can be used to scale the intensity of the measured ion intensity.

Figure 12:
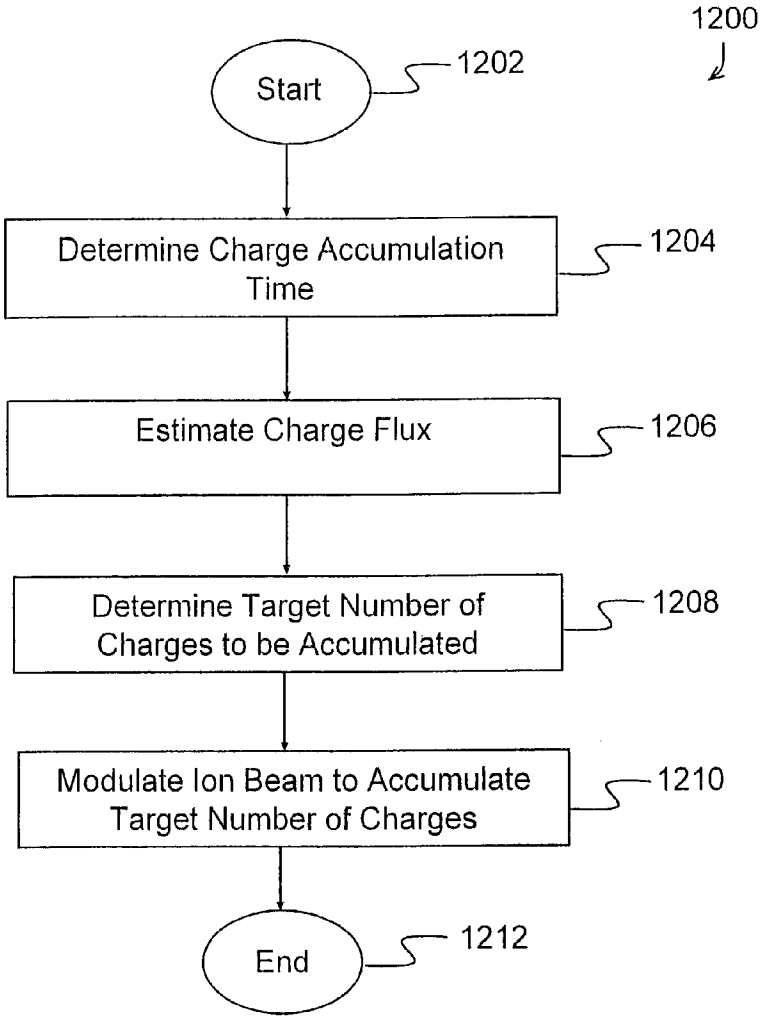
FIG. 12 is a flow diagram illustrating an example of a method for accumulating charge according to an implementation taught in the present disclosure.

FIG. 12 is a flow diagram 1200 illustrating an example of a method for controlling charge flux into a charge accumulation device. The flow diagram 1200 may also represent an apparatus or system configured to perform the illustrated method. Such an apparatus or system may, for example, have attributes similar to those described above and illustrated elsewhere in the Figures. The method begins at the starting point 1202. At block 1204, a charge accumulation time is determined. The charge accumulation time is a period of time during which charges are to be accumulated in the charge accumulation device. At block 1206, the charge flux of an ion beam to be processed during an experiment is estimated, such as by measuring the charge flux of a first ion beam produced from an ion source. At block 1208, based on the estimated or measured charge flux, a target number of charges to be accumulated in the charge accumulation device is determined. At block 1210, based on the determined target number of charges, an ion beam produced from the ion source is modulated. The ion beam modulated may be a subsequent population of ions to be analyzed during the experiment after a pre-scan of a preceding ion population has been executed to estimate charge flux (block 1206). The technique employed to modulate the ion beam may be the pulse frequency modulation technique or proportional modulation technique as described above. The method ends at the ending point 1212.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A method for processing ions by controlling charge flux into a charge accumulation device, comprising:

determining a charge accumulation time during which charges are to be accumulated in the charge accumulation device;

measuring a charge flux of a first ion beam produced from an ion source;

based on the measured charge flux, determining a target number of charges to be accumulated in the charge accumulation device during the charge accumulation time; and based on the determined target number of charges, modulating a second ion beam produced from the ion source to cause the target number of charges from the second ion beam to be accumulated in the charge accumulation device during the charge accumulation time.

2. The method of claim 1, wherein measuring the charge flux includes transporting ions from the first ion beam to an ion detector.

3. The method of claim 1, wherein measuring the charge flux includes directing the first ion beam into the charge accumulation device and transporting ions from the charge accumulation device to an ion detector.

4. The method of claim 1, wherein measuring the charge flux includes directing the first ion beam into the charge accumulation device, transporting ions from the charge accumulation device to an additional charge accumulation device, and transporting ions from the additional charge accumulation device to an ion detector.

5. The method of claim 1, wherein measuring the charge flux includes directing the first ion beam into the charge accumulation device, transporting ions from the charge accumulation device to an ion trap, and operating the ion trap to measure a value correlated to the charge flux.

6. The method of claim 5, wherein the ion trap is a part of a Fourier Transform mass spectrometer.

7. The method of claim 1, further including transporting the second ion beam to an ion lens element interposed between the ion source and the charge accumulation device, wherein modulating the second ion beam includes applying controlled voltage potentials to the ion lens element to deflect the second ion beam by a desired degree off an axis of the ion lens element.

8. The method of claim 7, wherein applying the voltage potentials includes chopping the second ion beam into a number of discrete pulses, and modulating the second ion beam further includes transporting the pulses into the charge accumulation device to cause the target number of charges from the second ion beam to be accumulated in the charge accumulation device during the charge accumulation time.

9. The method of claim 8, wherein each pulse has a temporal pulse width and the pulses are transported at a pulse frequency, and further including determining the pulse width and the pulse frequency based on the determined target number of charges.

10. The method of claim 7, wherein applying the voltage potentials includes chopping the second ion beam into a number of discrete pulses, and modulating the second ion beam further includes spreading ions of the pulses apart in time and space to transform the pulses into a continuous ion beam, and directing the continuous ion beam into the charge accumulation device to cause the target number of charges from the second ion beam to be accumulated in the charge accumulation device during the charge accumulation time.

11. The method of claim 7, wherein the degree to which the second ion beam is deflected off the axis corresponds to a percentage of ions of the second ion beam being transported into the charge accumulation device, and modulating the second ion beam further includes transporting the percentage of ions into the charge accumulation device to cause the target number of charges from the second ion beam to be accumulated in the charge accumulation device during the charge accumulation time.

12. An ion processing device, comprising:

an evacuable housing having an interior;

an ion exit communicating with the interior;

an ion guiding device in the interior, at least a portion of the ion guiding device being arranged about an ion beam axis passing through the ion exit; and means for deflecting an ion beam by a desired degree off the ion beam axis and away from the ion exit and transferring a target number of charges of the ion beam from the ion guiding device into the ion exit over a fixed charge accumulation time.

13. The ion processing device of claim 12, wherein the ion guiding device includes at least two ion deflector elements disposed about the ion beam axis and configured to respectively receive independently controllable voltage signals.

14. The ion processing device of claim 12, wherein the ion guiding device includes at least two ion deflector elements disposed about the ion beam axis, and the deflecting means includes means for controlling voltage potentials applied to the at least two ion deflector elements.

15. The ion processing device of claim 12, wherein the ion guiding device includes an ion deflector electrically communicating with the deflecting means, an ion entrance lens interposed between the ion deflector and the ion exit, and an ion focus lens, and wherein the ion deflector is interposed between the ion entrance lens and the ion focus lens.

16. The ion processing device of claim 12, wherein the housing includes a first chamber, a second chamber, and an ion guide exit lens by which the first chamber communicates with the second chamber, and wherein the ion guiding device includes a first ion guiding component in the first chamber and a second ion guiding component in the second chamber, the second ion guiding component including an ion deflector electrically communicating with the deflecting means.

17. The ion processing device of claim 12, further including a charge accumulation device communicating with the housing interior via the ion exit, wherein the deflecting means transfers the target number of charges through the ion exit and into the charge accumulation device over the fixed charge accumulation time.

18. The ion processing device of claim 12, further including an ion containment device communicating with the ion exit and a charge accumulation device communicating with the ion containment device, wherein the deflecting means transfers the target number of charges through the ion exit and into the charge accumulation device over the fixed charge accumulation time via the ion containment device.

19. The ion processing device of claim 12, further including an ion detector positioned to receive ions from the ion beam.

20. The ion processing device of claim 12, wherein:

the housing includes a first chamber, a second chamber communicating with the ion exit, and an ion guide exit lens interposed between the first chamber and the second chamber;

the ion guiding device includes an ion guiding section disposed in the first chamber and an ion deflecting device disposed in the second chamber between the ion guide exit lens and the ion exit;

the ion deflecting device includes at least two ion deflector elements arranged about the ion beam axis, wherein the ion beam axis nominally runs from the ion guiding section, through the ion exit lens, between the at least two ion deflector elements, and through the ion exit; and the ion beam deflecting means includes circuitry configured to apply controlled voltage potentials respectively to the at least two ion deflector elements to deflect an ion beam passing through the ion deflecting device by a desired degree off the ion axis and transfer a target number of charges of the ion beam through the ion exit aperture over a fixed charge accumulation time.

* * * * *